US005429535A

United States Patent [19]

Liese

[11] Patent Number: 5,429,535

[45] Date of Patent: Jul. 4, 1995

[54] SWIMMING AID

[76] Inventor: Grover J. Liese, 5949-C Kalanianole Hwy., Honolulu, Hi. 96821

[21] Appl. No.: 346,430

[22] Filed: Nov. 29, 1994

[51] Int. Cl.[6] ..... A63B 31/10

[52] U.S. Cl. ..... 441/56

[58] Field of Search ..... 441/56, 57, 58

[56] References Cited

U.S. PATENT DOCUMENTS

| | | | |
|---|---|---|---|
| 1,773,440 | 8/1930 | Sbrolla | 441/57 |
| 2,016,538 | 10/1935 | Borgman . | |
| 2,139,601 | 12/1938 | Piccardi . | |
| 2,980,925 | 4/1961 | Wolshin | 441/57 |
| 3,257,673 | 6/1966 | Rademacher | 441/57 |
| 3,742,539 | 7/1973 | Okuniewski et al. | 441/58 |
| 4,548,588 | 10/1985 | Kosuge | 441/57 |

*Primary Examiner*—Jesus D. Sotelo
*Attorney, Agent, or Firm*—Welsh & Katz, Ltd.

[57] ABSTRACT

A swimming aid is worn on the hand and secured to and between the forefinger and the thumb of a swimmer. The swimming aid includes a fan-shaped body portion having a relatively wide frontal edge and two lateral edges tapering rearwardly toward an apex adjacent a webbed crotch portion of the hand formed between the forefinger and the thumb. The swimming aid has a crotch receiving portion formed towards the apex of the body portion for receiving and sealingly communicating with the webbed crotch portion of the hand. Also included is a thumb receiving portion and a forefinger receiving portion, both extending laterally from the lateral edges of the body portion respectively, intermediate the wide frontal edge and the apex. The thumb and forefinger receiving portions are integrally formed with the body portion and encircle and retain the thumb and the forefinger. The body portion is formed from material sufficiently rigid to resist displacement of the thumb towards the forefinger along a plane defined by the body portion when the thumb and forefinger are retained by the thumb and forefinger receiving portions, respectively. However, the body portion is sufficiently flexible to allow retention of the opposable nature of the thumb causing the body portion to bend away from a plane defined by the thumb and the forefinger such that the thumb and forefinger can grasp objects therebetween when the thumb and forefinger are retained by the thumb and forefinger receiving portions.

9 Claims, 2 Drawing Sheets

SWIMMING AID

BACKGROUND OF THE INVENTION

This invention relates generally to a swimming device and more particularly to a swimming aid adapted to be worn on the hands of a swimmer where the aid increases the ability of the swimmer to be propelled through the water by increasing the effective surface area of the hands.

Enjoyment of water sports in recent years has extended to sub-surface swimming and increased propulsion speeds by means of swim fins and other similar equipment. Such equipment is typically worn on the feet to increase the effective surface area of the feet to gain an increase in speed through the water. Other devices exist which attach to the hands off the swimmer to further increase the effective surface area of the hands to accomplish the same purpose.

Known swimming devices that attach to the hands include webbed gloves and finger webs that attach to some or all of the fingers of the hand. Typically, a webbed glove includes finger receptacles between which a flexible webbing material is attached. However, such material is often made of canvas or other similar fabric and is highly flexible. Thus, the material offers no resistance to the lateral movement of the fingers such that the fingers can easily be brought together. A swimmer's natural tendency is to place the fingers of the hands adjacent each other in a cup-like configuration to form a relatively solid planar surface. Such fabric webbing between the fingers is only effective when spread between the fingers to increase the effective surface area. Since known webbed gloves do not provide stiffening means to keep adjacent fingers spread apart, the swimmer often reverts to the natural cupped configuration, thus, defeating the purpose of the device.

Other swimming devices include webbed material disposed between two adjacent fingers, typically, between the thumb and the forefinger. Often, adjustable finger straps or loops are provided to attach the webbing to,the fingers. These loops are typically cumbersome to adjust and create user dissatisfaction.

Typical webbed swimming devices disposed between the thumb and the forefinger usually have a gap between the webbing material and the contour of they fingers, with a particularly pronounced gap between the webbing material and the natural crotch or webbed portion of the hand at the apex of the thumb and the forefinger. This gap allows water to flow past the webbed portion thus, reducing swimming efficiency since the surface area of the hand in combination with the surface area of the swimming device is not fully utilized. Additionally, during the swimmer's return stroke the gap may cause the webbed portion to wobble or flap. This may also reduce swimming efficiency and create user distraction sufficient to break mental concentration.

Other known swimming devices cover all of the fingers and significantly reduce manual dexterity. Thus, a swimmer cannot easily grasp objects in the water, such as a surfboard, water ski, or other similar equipment. Often, the swimming glove material is smooth or slippery thus, reducing the swimmer's ability to retain a firm grasp on the object.

Accordingly, it is an object of the present invention to provide a swimming aid that substantially overcomes the above problems.

It is another object of the present invention to provide a swimming aid integrally formed from a semi-flexible material.

It is further object of the present invention to provide a swimming aid which tends to keep the thumb and forefinger spread apart.

It is still another object of the present invention to provide a swimming aid which allows the swimmer to grasp objects between the forefinger and opposing thumb while wearing the swimming aid.

It is yet another object of the present invention to provide a swimming aid that sealingly mates with the crotch portion of the hand at the apex of the thumb and forefinger to form a solid planar surface.

It is another object of the present invention to provide a swimming aid having a plurality of finger loops for attaching to the fingers of the hand.

SUMMARY OF THE INVENTION

The novel swimming aid provides an increase in the ability of the swimmer to be propelled through the water while swimming by increasing the effective surface area of the hands. The swimming aid attaches to the thumb and the forefinger of the hand by means of finger loops. A single thumb loop retains the thumb while two forefinger loops retain the forefinger and "straddle" the proximal interphalangeal joint of the index or forefinger.

More specifically, the swimming aid is worn on the hand and is secured to and between the forefinger and the thumb of the swimmer. The swimming aid includes a fan-shaped body portion having a relatively wide frontal edge and two lateral edges tapering rearwardly toward an apex adjacent a crotch portion of the hand formed between the forefinger and the thumb of the hand. The swimming aid has a crotch receiving portion formed towards the apex of the body portion for sealingly communicating with the crotch portion of the hand. Attachment to the fingers is facilitated by a thumb and a forefinger receiving portion extending laterally from the lateral edges of the body portion, respectively, the receiving portions disposed intermediate the frontal edge and the apex of the body portion. The thumb and forefinger receiving portions are integrally formed with the body portion and encircle and retain the thumb and tile forefinger.

The fan shaped body portion is formed from material sufficiently rigid to resist displacement of the thumb towards the forefinger along a plane defined by the body portion when the thumb and forefinger are retained within the finger receiving portions. However, the fan shaped body portion is sufficiently flexible to allow displacement of the thumb towards the forefinger causing the body port ion to bend away from a plane defined by the thumb and the fore finger such that the thumb and forefinger can grasp objects therebetween when the thumb and forefinger are retained within the finger receiving portions.

The features of the present invention which are believed to be novel are set forth with particularity in the appended claims. The invention, together with further objects and advantages thereof, may best be understood by reference to the following description in conjunction with the accompanying drawings wherein like reference numerals designate like elements throughout the several views.

DETAILED DESCRIPTION OF THE INVENTION

Figure 1:
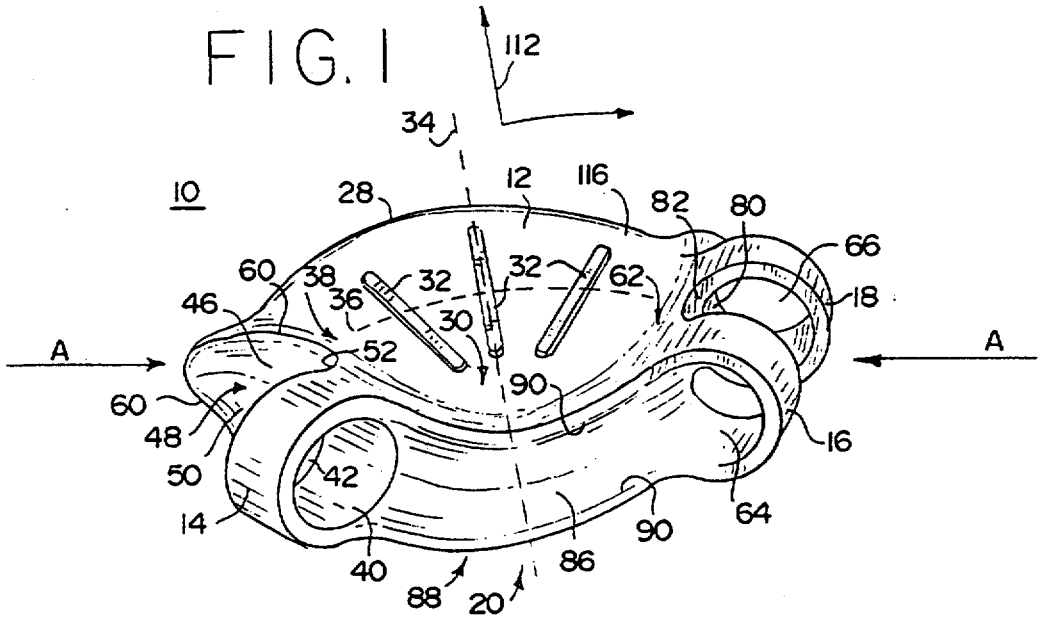
FIG. 1 is a perspective view of one embodiment of a swimming aid according to the present invention.
Figure 2:
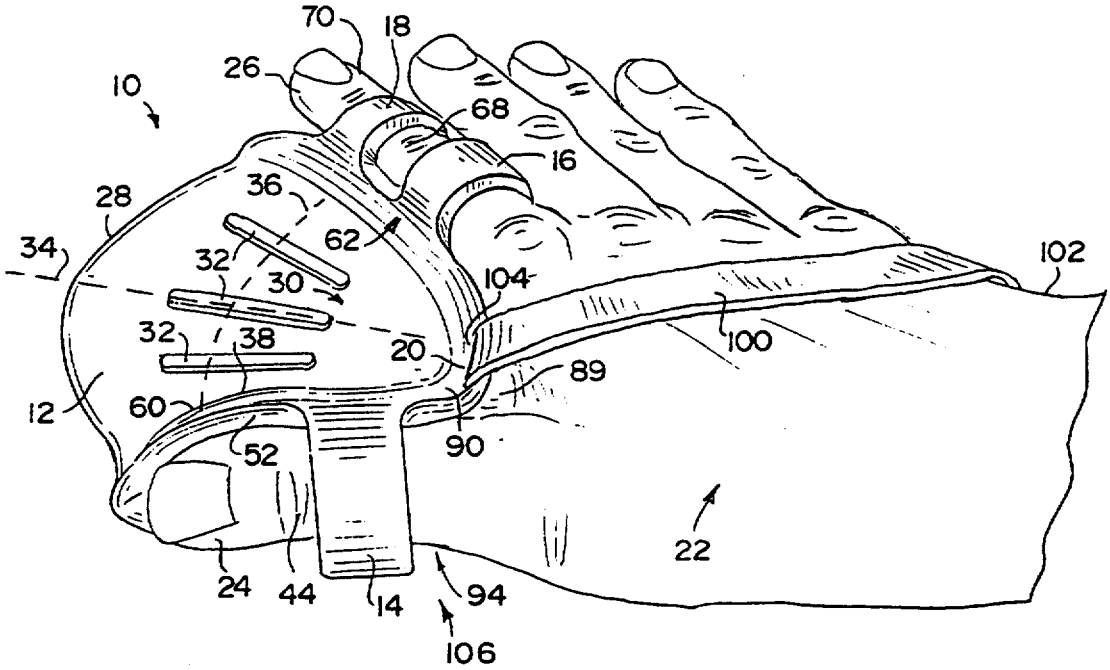
FIG. 2 is a perspective view of the swimming aid of FIG. 1 shown worn on the hand of a swimmer.

Referring now to FIGS. 1 and 2, a swimming aid is shown generally as 10 and is preferably molded from plastic, rubber or other suitable flexible or moldable material. The swimming aid 10 includes a fan-shaped body portion 12, a thumb loop 14, two forefinger loops 16 and 18, and a crotch receiving portion 20. The body portion 12 fills the space of a hand 22 between a thumb 24 and a forefinger 26 to increase the effective surface area of the hand so that the swimmer gains an increase in propulsion.

The body portion 12 is generally fan-shaped or V-shaped having a relatively wide frontal edge 28 that tapers inwardly toward an apex 30. The body portion 12 may have one or more intermediate and preferably upstanding reinforcing ribs 32 to impart added strength and rigidity. The ribs 32 may be aligned parallel to an axis 34 defined between the frontal edge 28 and the apex 30 or preferably may diverge from the apex 30 toward the frontal edge. The ribs 32 provide resistance against bending along the axis 34 but do not inhibit bending of the body portion along a direction transverse to the axis. The body portion 12 is relatively flat but may have a slight curved contour, as indicated by line 36 to facilitate bending of the body portion in a direction transverse to the axis 34 when the swimmer brings the thumb 24 and the forefinger 26 together to grasp an object. Additionally, the slight curved contour increases swimmer hand comfort.

The thumb loop 14 is preferably integrally molded with the body portion 12 and extends outwardly and substantially transverse to a first edge 38 of the V-shaped body portion. The thumb loop 14 has a generally tubular shaped inside surface 40 forming an aperture 42 adapted to receive and retain the thumb 24 at a point proximal to the second knuckle 44 of the thumb 24. The thumb 24 may bend upwardly or downwardly depending on swimmer comfort and may engage a thumb retaining pocket 46 formed in the first edge 38 of the body portion 12. The thumb retaining pocket 46 is formed from a thumb channels 48 in the first edge 38 and has an arcuate bend 50 at a point along the length of the thumb channel corresponding to the natural shape of the ball of the thumb 24. The thumb channel 48 has a proximal end 52 which terminates in the thumb loop 14. Walls 60 of thumb channel 48 are preferably curved and generally correspond to the transverse curvature of the thumb 24. This increases user comfort in addition to providing an ergonomically correct and secure grip for the swimmer.

On a second edge 62 of the V-shaped body portion 12 and disposed opposite of the first edge 38, the two forefinger loops 16 and 18 are provided. The forefinger loops 16 and 18 are also preferably integrally molded with the body portion 12 and extend outwardly and substantially transverse to the second edge 62. Each forefinger loop 16 and 18 has a tubular inside surface 64 forming an aperture 66 adapted to receive and retain the forefinger 26. The proximal forefinger loop 16 contacts and retains the forefinger 26 at a point below a second knuckle 68 or proximal interphalangeal articulations or joint while the distal forefinger loop 18 contacts and retains the forefinger in a region between the proximal 68 and a distal 70 interphalangeal articulation or joint. This feature provides for secure attachment of the body portion 12 to the forefinger 26 while allowing the forefinger to bend naturally at the proximal interphalangeal joint 68. Thus, with the forefinger 26 slightly bend and the proximal interphalangeal joint 68 retained between the proximal 16 and the distal 18 forefinger loops, added gripping ability is provided Since the angle of the bent forefinger 26 resists axial movement of the forefinger relative to the forefinger loops thus, helping to retain the forefinger in place.

The underside of the forefinger 26 directly engages a forefinger retaining channel 80 formed from the second edge 62 of the body portion 12. Walls 82 of forefinger retaining channel 80 are preferably curved and generally correspond to the transverse curvature of the forefinger 26. This also increases user comfort in addition to providing an ergonomically correct and secure grip for the swimmer.

A crotch receiving channel 86 formed between the thumb loop 14 and the proximal forefinger loop 16 is disposed on a third edge 88 of the body portion 12 to wards the apex 30 of the body portion. The crotch receiving channel 86 is preferably a continuation of the forefinger receiving channel 80 and is adapted to engage the webbed or crotch portion 89 of the hand 22 between the thumb 24 and the forefinger 26. Walls 90 of the crotch receiving channel 86 are preferably curved and specifically correspond to the webbed or crotch portion 89 of the swimmer's hand 22. The walls 90 of the crotch receiving channel 86 preferably extend outwardly further than the walls 82 of the forefinger retaining channel 80 to provide overlap on top 92 and bottom 94 portions of the webbed or crotch portion 89 of the hand 22 to create a seal therebetween. When the swimmer inserts the thumb 24 and forefinger 26 into the thumb loop 14 and forefinger loops 16 and 18, respectively, the crotch receiving channel 86 engages the webbed or crotch portion 89 such that the walls 90 of the crotch receiving channel engage and sealingly mate with the crotch portion of the hand.

Such a sealing feature offers a significant advantage over other swimming devices which only provide a webbing material between the thumb and forefinger while leaving a gap between the device and the crotch portion of the hand. Such a gap allows water to flow between the swimming device and the crotch of the hand thus, reducing the effective surface area off the device and hence, its effectiveness. Additionally, such a gap and flow of water therethrough may create a fluid disturbance which tends cause vibration or wobble of the swimming aid. Such vibration and wobble may tend to loosen the Swimmer's grip upon the device. The crotch receiving channel 86 eliminates this problem by creating a seal between the swimming aid 10 and the webbed or crotch portion 89 of the hand 22 such that the combination of the swimming aid 10 and the surface of the hand 22 presents a solid planar surface against which water pressure is applied when swimming.

Alternatively, a strap 100 may be included which extends to and wraps around the wrist 102 and attaches to a top 104 and a bottom 106 portion of the body portion 12 by means well known in the art. The strap 100 may contact the wrist 102 at any suitable angle sufficient to allow the swimming aid 10 to be securely attached to the hand. Such means may include a VELCRO strap, a belt and buckle arrangement, or other suitable methods. The strap 100 may help to retain the swimming aid 10 on the swimmer's hand 22 in very turbulent or violent water such as when surfing on large waves. Additionally, the strap 100 may prevent loss of the swimming aid 10 should the swimming aid be released from the swimmer's hand 22. The strap 100 may also be attached to the swimming aid 10 at the thumb loop 14 and the forefinger loops 16 and 18, or any other suitable connection point.

The material from which the swimming aid 10 is formed may be lighter than water so that it floats on the surface of the water. This prevents loss of the swimming aid 10 if separated from the swimmer. Optionally, an air pocket may be disposed within the swimming aid 10 to as sure floatation when detached from the hand 22 of the swimmer.

Figure 3:
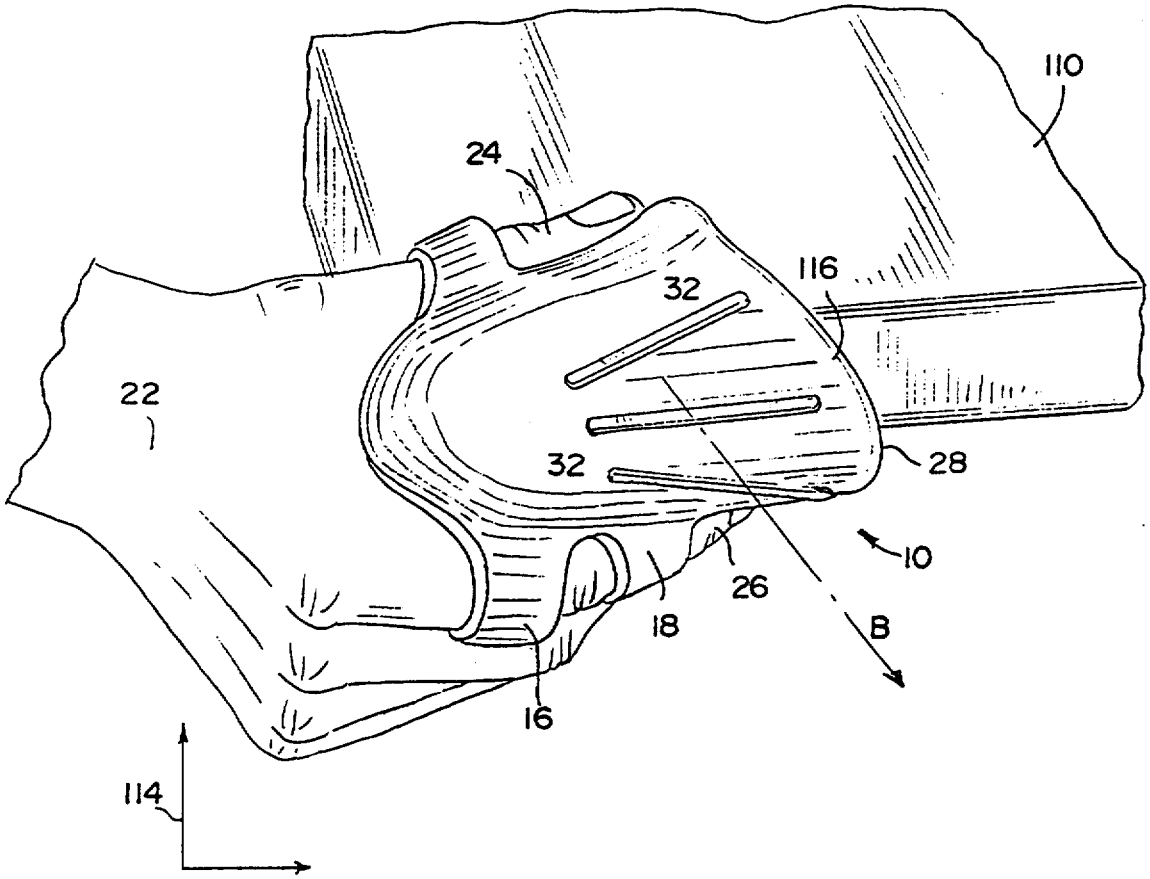
FIG. 3 is a perspective view of the swimming aid of FIG. 2 shown bend as the fingers of the hand close to grasp an object.

Referring now to FIGS. 1 and 3, FIG. 3 shows the swimming aid 10 worn on the hand 22 where the thumb 24 and forefinger 26 of the hand are brought together to grip an object 110. The material from which the swimming aid 10 is formed is sufficiently rigid to resist displacement of the thumb 24 towards the forefinger 26 along a plane 112 defined by the body portion 12 when the thumb 14 and the forefinger are retained by the thumb loop 14 and forefinger loops 16 and 18, respectively. The body portion 12 resists force applied by the thumb 24 and the forefinger 26 along the arrows labeled as "A", such that the thumb and the forefinger tend to remain spread apart absent intentional and overriding grasping force. However, the material is sufficiently flexible to allow displacement of the thumb 24 towards the forefinger 26 causing the body portion 12 to bend away from a plane 114 defined by the thumb 24 and the forefinger 26, as shown by the arrow labeled "B". Since the body portion 12 may have a slight bend or bow 36, inward displacement of the thumb 24 toward the forefinger 26 causes the body portion to bend in the direction shown by arrow "B" when the swimmer grasps the object 110 while wearing the swimming aid 10.

This feature allows the object 110, such as a surfboard or a water ski to be easily grasped by the swimmer while wearing the swimming aid 10. Other known swimming devices are suitable for swimming only and must be removed to grasp objects while being worn by the swimmer. In summary, the body portion 12 is sufficiently stiff to keep the thumb 24 and forefinger 26 of the swimmer separated yet sufficiently flexible to bend when the swimmer grasps objects between the thumb and the forefinger.

The frontal edge 28 of the body portion 12 may extent past thumb channel 48 and the forefinger retaining channel 80 and may even extend beyond the tip of the forefinger 26. Since the material from which the swimming aid 10 is formed is relatively stiff, such an extending portion 116 further increases the effective surface area of the swimming aid 10 without bending against water pressure when in use. It is contemplated that longer stiffening ribs 32 would allow further extension of the frontal edge 28.

Figure 4:
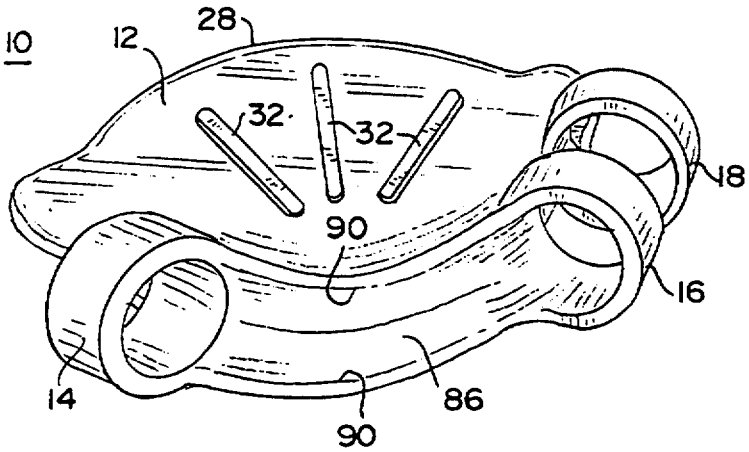
FIG. 4 is a perspective view of an alternate embodiment of the swimming aid according to the present invention.

Referring now to FIGS. 1 and 4, in FIG. 4 an alternate embodiment of the swimming aid 10 is shown having a substantially uniform thickness throughout the body portion 12. Since the body portion 12 is of a uniform thickness, no thumb channel 48 or forefinger retaining channel 80 exist since such a uniform thickness is typically thinner than the diameter of the fingers. The thumb loop 14 and the proximal 16 and distal 18 forefinger loops may be formed directly and integrally from the edge of the body portion 12. However, the crotch receiving channel 86 having walls 90 is included to maintain the seal with the crotch 89 (FIG. 2) of the hand 22. Preferably, the body portion 12 of uniform thickness may still have a generally curved shape to facilitate proper bending when the thumb 24 and the forefinger 26 are brought together. Alternatively, the body portion 12 may be slightly thicker along portions proximal to the thumb 14 and forefinger 16, 18 retaining loops to facilitate ease in manufacturing and to increase structural integrity.

Referring to FIGS. 1 and 2, in operation, the swimmer inserts his or her hand 22 into the swimming aid 10 by placing the thumb 24 into and through the thumb loop 14 and by placing the forefinger 26 into and through the forefinger loops 16 and 18. The swimmer typically wears two swimming aids 10, one for each hand. Optionally, the swimmer may fasten the strap 100 around the hand to further secure the swimming aid 10 to the hand. The swimmer then swims using strokes of his or her choice and experiences an increase in propulsion speed and efficiency since the effective area of the hands 22 are significantly increased.

In another embodiment, the thumb loop 14 and forefinger loops 16, 18 are replaced with a tubular shaped thumb and forefinger receptacle much like the fingers of a glove with one edge of each receptacle joined to,an edge of the body portion 12. The thumb and forefinger receptacles attach to each side of the body portion 12 and may be constructed of fabric or other suitable material such that the thumb and forefinger are each inserted into the respective receptacles and are secured within. The end of the thumb and the forefinger receptacle nearest the tips of the fingers may be open or closed, depending on customer preference. The thumb and forefinger receptacle may be joined by a continuous portion of material covering a portion of the top and bottom of the hand and may appear as a glove having only the thumb and the forefinger receptacles while the three remaining fingers are unrestrained. The body portion 12 affixed between the thumb and forefinger receptacles may be constructed of fabric or material similar to that Of the thumb and forefinger receptacles and may contain a stiff material disposed within for imparting appropriate stiffness needed to increase the effective surface area of the hands.

It is contemplated that the swimming aid 10 may be manufactured in a variety of sizes to fit a wide variety of hand sizes. Alternatively, the swimming aid 10 may be formed from a stretchable material and manufactured in a limited number of sizes such that the body portion 12 or the thumb 14 and forefinger loops 16 and 18 may stretch to accommodate various hand sizes.

A specific embodiment of the swimming aid according to the present invention has been described for the purpose of illustrating the manner in which the invention may be made and used. It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

What is claimed is:

1. A swimming device configured to be worn on the hand and secured to and between the forefinger and the thumb of a swimmer, the device comprising:

a fan-shaped body portion;

the body portion having a frontal edge and two lateral edges tapering rearwardly from the frontal edge toward an apex adjacent a webbed crotch portion of the hand, said webbed crotch portion of the hand formed between the forefinger and the thumb;

a crotch receiving portion for med towards the apex of the body portion for receiving and sealingly communicating with the webbed crotch portion of the hand wherein the crotch receiving portion includes a channel having outwardly extending side walls, said channel adapted to receive and sealingly mate with the webbed crotch portion of the hand such that a flow of water does not pass therebetween;

a thumb receiving portion extending laterally from one of the lateral edges of the body portion intermediate the frontal edge and the apex, said thumb receiving portion being integrally formed with the body portion and adapted to encircle and retain the thumb therewithin; and a forefinger receiving portion extending laterally from the other lateral edge of the body portion intermediate the frontal edge and the apex, said forefinger receiving portion being integrally formed with the body portion and adapted to encircle and retain the forefinger therewithin.

2. The device according to claim 1 wherein the body portion is formed from material sufficiently rigid to resist displacement of the thumb towards the forefinger along a plane defined by the body portion when the thumb and the forefinger are retained within the thumb and the forefinger receiving portions, respectively.

3. The device according to claim 1 wherein the body portion is formed from material sufficiently flexible to allow displacement of the thumb towards the forefinger while the thumb is retained in the thumb receiving portion and while the forefinger is retained in the forefinger receiving portion wherein said displacement causes the body portion to bend away from a plane defined by the thumb and the forefinger such that the thumb and forefinger can grasp objects therebetween.

4. The device according to claim 1 wherein the thumb receiving portion includes one thumb loop adapted to encircle and retain the thumb, said thumb loop encircling the thumb in an area overlapping a proximal phalanx of the thumb.

5. The device according to claim 1 wherein the forefinger receiving portion includes a proximal and a distal forefinger loop adapted to encircle and retain the forefinger, the loops having a spaced relationship therebetween such that the proximal forefinger loop encircles the forefinger in an area overlapping a proximal phalanx and the distal forefinger loop encircles the forefinger in an area overlapping a middle phalanx.

6. The device according to claim 5 wherein the proximal and distal forefinger loops flexingly allow the forefinger to bend.

7. The device according to claim 1 wherein the body portion is provided on at least one side thereof with stiffening ribs extending from a line adjacent the frontal edge of the body portion rearwardly toward the apex.

8. The device according to claim 1 further including a strap for disposal about the wrist, said strap having a first end fixedly secured to a top surface of the body portion and a second end fixedly secured to a bottom surface of the body portion.

9. The device according to claim 1 further including a strap for disposal about the wrist, said strap having a first end fixedly secured to the thumb receiving portion and a second end fixedly secured to the forefinger finger receiving portion.

* * * * *